US011243496B2

(12) United States Patent
Silvant

(10) Patent No.: US 11,243,496 B2
(45) Date of Patent: Feb. 8, 2022

(54) ANNULAR ROTATING BEZEL SYSTEM COMPRISING A SPRING RING PROVIDED WITH AT LEAST TWO LUGS

(71) Applicant: Omega SA, Biel/Bienne (CH)

(72) Inventor: Olivier Silvant, Macolin (CH)

(73) Assignee: Omega SA, Biel/Bienne (CH)

( * ) Notice: Subject to any disclaimer, the term of this patent is extended or adjusted under 35 U.S.C. 154(b) by 400 days.

(21) Appl. No.: 16/458,638

(22) Filed: Jul. 1, 2019

(65) Prior Publication Data

US 2020/0050153 A1 Feb. 13, 2020

(30) Foreign Application Priority Data

Aug. 8, 2018 (EP) ..... 18187998

(51) Int. Cl.
*G04B 19/28* (2006.01)
*G04B 19/18* (2006.01)

(52) U.S. Cl.
CPC ..... *G04B 19/283* (2013.01); *G04B 19/18* (2013.01)

(58) Field of Classification Search
CPC ..... G04B 19/283; G04B 19/18; G04B 45/00; G04B 47/04; G04B 19/00; G04B 47/00; G04B 37/0463; G04B 19/286; G04B 37/00; G04B 37/08; G04B 37/0008
USPC ..... 368/295
See application file for complete search history.

(56) References Cited

U.S. PATENT DOCUMENTS 5,822,279 A * 10/1998 Cuche ..... G04B 19/286 368/295
9,348,315 B2 * 5/2016 Cattaneo ..... G04B 19/223
2015/0185702 A1 7/2015 Silvant
(Continued)

FOREIGN PATENT DOCUMENTS

AU 3 030 497 A 1/1998
CH 712 742 A2 1/2018
CN 1079558 A 12/1993
(Continued)

OTHER PUBLICATIONS

European Search Report dated Feb. 7, 2019 in European Application 18187998.2, filed on Aug. 8, 2018 (with English Translation of Categories of Cited Documents).
(Continued)

*Primary Examiner* — Edwin A. Leon
(74) *Attorney, Agent, or Firm* — Oblon, McClelland, Maier & Neustadt, L.L.P.

(57) ABSTRACT

An annular rotating bezel system includes a rotating bezel, a toothed ring having a toothing provided with a plurality of teeth regularly distributed over an edge of the toothed ring, and a spring ring which extends in a plane in which it is capable of deforming elastically along a radius. The spring ring cooperates elastically with the toothed ring. The spring ring includes at least two lugs, each lug being configured to be elastically and radially engaged with the toothing of the toothed ring in at least one position of the bezel. At least two lugs are offset from each other by an offset angle, the or each offset angle between two successive lugs having a value different from an integer sub-multiple of 360 degrees, such that, in each position of the bezel, only one lug is elastically and radially engaged with the toothing of the toothed ring.

19 Claims, 5 Drawing Sheets

(56) References Cited

U.S. PATENT DOCUMENTS

2018/0032033 A1 2/2018 Mollier et al.

FOREIGN PATENT DOCUMENTS

| | | | |
|---|---|---|---|
| CN | 1591240 | A | 3/2005 |
| CN | 104412176 | A | 3/2015 |
| CN | 104730903 | A | 6/2015 |
| CN | 105814497 | A | 7/2016 |
| EP | 0 770 937 | A1 | 5/1997 |
| EP | 2 672 333 | A1 | 12/2013 |
| JP | 2010-90526 | A | 4/2010 |
| WO | WO 97/45775 | A1 | 12/1997 |

OTHER PUBLICATIONS

Indian Office Action dated Dec. 16, 2020 in Indian Patent Application No. 201944031531, 5 pages.
Combined Chinese Office Action and Search Report dated Oct. 20, 2020 in Chinese Patent Application No. 201910720875.1 (with English translation of Category of Cited Documents), 7 pages.

* cited by examiner

ANNULAR ROTATING BEZEL SYSTEM COMPRISING A SPRING RING PROVIDED WITH AT LEAST TWO LUGS

This application claims priority to European Patent Application No. 18187998.2, filed Aug. 8, 2018, the entire contents of which are incorporated by reference herein.

FIELD OF THE INVENTION

The invention concerns an annular rotating bezel system.

The invention also concerns a watch case comprising a middle part and the annular rotating bezel system rotatably mounted on the case middle.

The invention also concerns a watch including the watch case. The watch is, for example, a diver's watch, although this is not limiting in the context of the present invention.

BACKGROUND OF THE INVENTION

Known annular rotating bezel systems comprise a rotating bezel, a toothed ring and a spring ring. A rotating bezel system of this type is, for example, described in European Patent No 2672333A1. The spring ring is angularly joined to the rotating bezel, and the toothed ring is angularly joined to the case middle. The toothed ring has several teeth regularly distributed over its outer edge, in this case 120 teeth in the example embodiment provided in this document. The spring ring extends in a plane in which it is capable of deforming elastically along a radius and cooperates elastically with the toothed ring. To achieve this, three lugs in the form of elastic arms and intended to cooperate with the toothed ring are made on an inner edge of the spring ring, by cutting the latter. The three lugs are regularly distributed over the inner edge of the spring ring. Consequently, regardless of the position of the bezel, the three lugs are always engaged with the toothing of the toothed ring at the same time, which results in 120 stable positions for the rotating bezel. The number of positions therefore corresponds to the number of teeth. The position indexing resolution of the rotating bezel is thus limited by the total number of possible positions of the bezel, in this case 120 positions. However, the greater the number of teeth for a given diameter, the smaller the dimension of the teeth, which entails a high wear factor for said teeth. It is thus desirable to find a technical solution that can ensure, for a given bezel diameter, a number of stable positions that is higher than the number of teeth in the ring toothing, without thereby increasing the wear of the ring toothing.

SUMMARY OF THE INVENTION

It is therefore an object of the invention to provide an annular rotating bezel system which, with the same number of teeth in the toothed ring as in systems of the prior art, makes it possible to obtain a greater number of possible stable positions for the rotating bezel, and which overcomes the aforementioned drawbacks of the prior art.

To this end, the invention concerns an annular rotating bezel system, which includes the features mentioned in the independent claim 1.

Specific embodiments of the system are defined in the dependent claims 2 to 16.

One advantage of the present invention is that, with the same number of teeth in the toothed ring as in the systems of the prior art, it is possible to obtain a larger number of possible stable positions for the rotating bezel. Indeed, by means of the configuration wherein the or each offset angle between two successive lugs has a value different from an integer sub-multiple of 360 degrees, a single lug is elastically or radially engaged with the toothing of the toothed ring in each position of the bezel. The total number of possible positions for the bezel is in that case provided by the result of multiplying the number of lugs on the spring ring by the number of teeth on the spring ring. This makes it possible to obtain a larger number of possible stable positions for the rotating bezel.

Conversely, it is, for example, possible, by means of the system of the invention, to increase the size of the teeth and to reduce the number of teeth on the toothed ring in order to decrease the wear thereof, while still maintaining the same number of stable positions of the bezel as in prior art systems.

Advantageously, the spring ring includes at least two thinned portions arranged to increase the flexibility of the spring ring in its plane, with each lug extending from one of the thinned portions. This increases the flexibility of the spring ring in its plane. Indeed, via the thinned portions it contains, the spring ring flexes in its plane, allowing the lugs it carries to move in and out of mesh with the toothed ring as the bezel rotates. This makes it possible to reduce the width required for the spring ring to operate in the system and thus to obtain a space saving as regards the width of the assembly.

Advantageously, the rotating bezel includes at least one bead or protrusion extending over an inner lateral face of the bezel, and the spring ring has, on an outer edge, at least one hollow in which the bezel protrusion is engaged. This means the spring ring can easily be rotatably connected to the rotating bezel, while facilitating the positioning of the spring ring in the bezel.

Advantageously, the toothed ring has, on an inner edge, at least one protrusion intended to be received in a hollow arranged in an external cylindrical surface of the case middle. This allows easy angular joining of the toothed ring to the case middle, while facilitating the positioning of the toothed ring on the case middle and allowing the rotating bezel system to be guided for assembly on the case middle.

According to a first example embodiment of the invention, the teeth of the toothed ring and the lugs of the spring ring each have an asymmetrical shape in the plane defined by the spring ring. In this first example embodiment, the spring ring can rotate with respect to the toothed ring in a single predefined direction: clockwise or anticlockwise depending on the shape chosen for the teeth. This first example embodiment of the invention thus corresponds to a unidirectional rotating bezel.

According to a second example embodiment of the invention, the teeth of the toothed ring and the spring ring lugs have a symmetrical shape in the plane defined by the spring ring. In this second example embodiment, the spring ring can rotate with respect to the toothed ring in one or other of the two directions: clockwise or anticlockwise. This second example embodiment of the invention thus corresponds to a two-directional rotating bezel.

Advantageously, the annular rotating bezel system consists of an independent module, said module being configured to be clipped onto the case middle. This provides a simple, practical means of mounting the rotating bezel system on the case middle, and also allows for easy disassembly. This makes it possible to simplify the method for manufacturing the watch case. The clip mounting system used forms a free hooking system.

To this end, the invention also concerns a watch case including the annular rotating bezel system described above, and which includes the features mentioned in the dependent claim 17.

A particular embodiment of the watch case is defined in the dependent claim 18.

To this end, the invention also concerns a watch including the watch case described above, and which includes the features mentioned in the dependent claim 19.

BRIEF DESCRIPTION OF THE DRAWINGS

The objects, advantages and features of the annular rotating bezel system according to the invention will appear more clearly in the following description, based on at least one non-limiting embodiment illustrated by the drawings, in which.

DETAILED DESCRIPTION OF THE INVENTION

Figure 1:
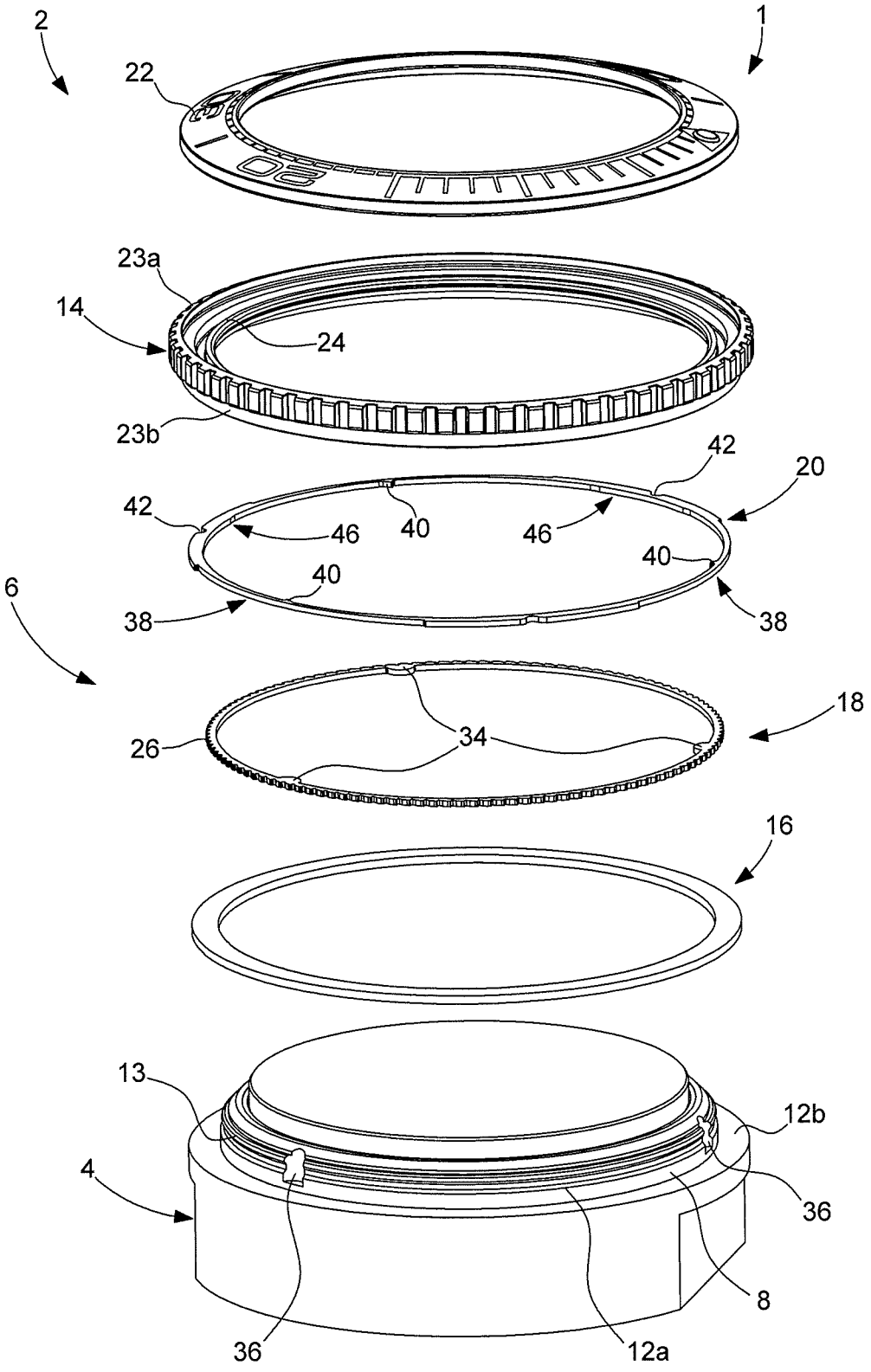
FIG. 1 is an exploded perspective view of the annular rotating bezel system according to the invention, comprising a spring ring and a toothed ring.

FIG. 1 represents a watch 1 provided with a watch case 2.

Watch case 2 typically includes a case middle 4. Watch case 2 also includes an annular rotating bezel system 6 and a timepiece movement that extends in a plane, the timepiece movement being omitted from the Figures for reasons of clarity. The annular rotating bezel system 6 is rotatably mounted on case middle 4. Preferably, as illustrated in FIG. 1, annular rotating bezel system 6 consists of an independent module. Annular rotating bezel system 6 is, for example, clipped onto case middle 4.

As illustrated in FIG. 1, case middle 4 is of annular shape. Case middle 4 includes an external cylindrical surface 8. External cylindrical surface 8 is, for example, provided with a peripheral shoulder defined by a lateral wall 12*a* and a base 12*b*. This peripheral shoulder serves as a housing for rotating bezel system 6. Lateral wall 12*a* includes an annular protrusion or bead 13 extending over the entire perimeter of lateral wall 12*a* and allowing rotating bezel system 6 to be clipped onto case middle 4. Annular rotating bezel system 6 rests on base 12*b*. Rotating bezel system 6 is thus mounted on case middle 4, from the top of the latter, thereby blocking system 6 in an axial direction perpendicular to the plane of the timepiece movement, while allowing rotation of the bezel around case middle 4. In the watch case 2 taken as an example in FIGS. 1 to 9, the configuration of the watch case is substantially circular. However, the invention is not limited to this watch case configuration, or to the other arrangements described above for case middle 4. The case middle may be made of metal, typically steel, titanium, gold, platinum, or of ceramic, typically made from alumina, zirconia or silicon nitride.

Annular rotating bezel system 6 includes a rotating bezel 14, a toothed ring 18 and a spring ring 20. Preferably, system 6 further includes an annular retaining ring 16. Also, preferably, system 6 further includes a decorative ring 22 press fitted onto rotating bezel 14. Decorative ring 22 bears, for example, graduations, typically diving graduations in the case of a diver's watch 1. Decorative ring 22 is for example made of ceramic.

Rotating bezel 14 is of annular shape and includes an upper surface 23*a* visible to the user and a lower surface 23*b*. As illustrated in FIG. 1, rotating bezel 14 is, for example, provided with an annular rim 24 on an inner edge. Annular rim 24 engages by clipping together with protrusion 13 of case middle 4, and forms therewith a free hooking system. Rotating bezel 14 is, for example, made of metal but could be made of any other material, for example, of ceramic.

Annular ring 16 holds toothed ring 18 and spring ring 20 in bezel 14, in an axial direction perpendicular to the plane of the timepiece movement. This facilitates the mounting of rotating bezel 14 on case middle 4. Preferably, annular ring 16 is pressed into rotating bezel 14, securing it thereto. In a variant not represented in the Figures, annular ring 16 is secured to case middle 4.

Annular ring 16 rests on base 12*b* of case middle 4, and thus encircles external cylindrical surface 8 of case middle 4. Annular ring 16 is configured to cooperate with external cylindrical surface 8 to allow rotation of rotating bezel 14 on case middle 4. Annular retaining ring 16 is, for example, a flat ring. In other variants of the invention, the annular retaining ring may comprise a simple annular ring of rectangular cross-section over the whole edge thereof pressed into bezel 14.

Toothed ring 18 includes a toothing 26. Toothing 26 is provided with several teeth regularly distributed over an edge of toothed ring 18, typically over an outer edge, over 360 degrees. Preferably, toothed ring 18 also has, on its inner edge, at least one protrusion 34 received in a hollow 36 provided in external cylindrical surface 8 of case middle 4. In the example embodiments illustrated in FIGS. 1 to 9, toothed ring 18 includes three protrusions 34 distributed over 360 and spaced apart from each other by 120 degrees. External cylindrical surface 8 of case middle 4 has three corresponding hollows 36. This system of protrusions 34/hollows 36 makes it easy to angularly join toothed ring 18 to case middle 4, while facilitating the positioning of toothed ring 18 on case middle 4. This system also allows rotating bezel system 6 to be guided for mounting on case middle 4. Thus, pressing from the top of system 6 causes protrusions 34 to engage in hollows 36, locking the elements inside system 6 and clipping system 6 onto case middle 4.

Toothed ring 18 is formed of a single piece of material. Toothed ring 18 is formed, for example, of a metal alloy, especially a cobalt based alloy (40% Co, 20% Cr, 16% Ni and 7% Mo) commercially known as phynox, or steel, typically a stainless steel such as 316L steel. In a variant, toothed ring 18 may be formed of a thermoplastic material, particularly a thermostable, semi-crystalline thermoplastic material, such as, for example polyarylamide (Ixef®), polyetheretherketone (PEEK) or made of a ceramic material such as zirconia or alumina.

As visible in FIGS. 2 to 9, toothed ring 18 is arranged to be inserted into spring ring 20, i.e. toothed ring 18 is sized to be able to be placed inside spring ring 20. Toothed ring 18 and spring ring 20 are concentric and coplanar and are held between lower face 23*b* of bezel 14 and an upper face of retaining ring 16.

Spring ring 20 extends in a plane in which it is capable of deforming elastically along one radius. Spring ring 20 engages elastically with toothed ring 18. For this purpose, spring ring 20 includes at least two lugs 40, each lug 40 being configured to be elastically and radially engaged with toothing 26 of toothed ring 18 in at least one position of bezel 14. In the example embodiments illustrated in FIGS. 1 to 9, toothed ring 20 includes three lugs 40. Lugs 40 are offset from each other by an offset angle $\vartheta_a$, $\vartheta_b$, $\vartheta_c$. Each offset angle $\vartheta_a$, $\vartheta_b$, $\vartheta_c$ between two successive lugs 40 has a value different from an integer sub-multiple of 360 degrees, as will be explained in detail below. In this manner, in each position of rotating bezel 14, only one lug 40 is elastically and radially engaged with toothing 26 of toothed ring 18. Thus, in each position of bezel 14, when one of lugs 40 is elastically and radially engaged with toothing 26, the remaining lug(s) 40 is/are in equilibrium on teeth of toothed ring 18. In other words, such lug(s) 40 is/are then no longer engaged with toothing 26. In this configuration, in each position of bezel 14, one and only one lug 40 is in contact with toothed ring 18 so that there is a rest position in which this lug 40 sits in a hollow between two teeth of toothed ring 18. The other lugs 40 are then in equilibrium on teeth of toothed ring 18, as will be described below. When the user takes hold of and rotates bezel 14, the flexibility of spring ring 20 causes spring ring 20 to deform elastically in its plane, allowing the first lug 40 to be released from the hollows of toothed ring 18 and returned to equilibrium on adjacent teeth. Another lug 40, different from the first lug, then moves into engagement again in toothing 26 of toothed ring 18. Bezel 14 then actually rotates by a corresponding angular sector into a new position.

Preferably, spring ring 20 has at least two thinned portions 38. Each lug 40 extends from one of thinned portions 38. In the example embodiments illustrated in FIGS. 1 to 9, spring ring 20 comprises three thinned portions 38 distributed over 360 degrees, each thinned portion 38 having one lug 40 arranged in a median part of thinned portion 38. The three thinned portions 38 are spaced apart from each other by 120 degrees. Thinned portions 38 are arranged to increase the flexibility of spring ring 20 in its plane. This configuration makes it possible, when toothed ring 18 is inserted inside spring ring 20, for one of lugs 40 to cooperate with toothing 26 of toothed ring 18.

Preferably, as illustrated in FIGS. 1 to 9, thinned portions 38 are thinned radially.

Also, preferably, spring ring 20 has on its outer edge at least one hollow 42 in which one protrusion of bezel 14 is engaged to join these two elements in rotation. In the example embodiments illustrated in FIGS. 1 to 9, spring ring 20 includes three hollows 42 distributed over 360 degrees and spaced apart from each other by 120 degrees, and rotating bezel 14 has three corresponding protrusions on an inner lateral face. Hollows 42 are arranged in portions 46 of spring ring 20 that are thicker than thinned portions 38 in median parts of these portions 46. Thus, lugs 40 and hollows 42 form an alternation on spring ring 20. This system of protrusions/hollows makes it easy to rotatably connect spring ring 20 to rotating bezel 14, while facilitating the positioning of spring ring 20 in bezel 14.

Spring ring 20 is formed of a single piece of material. Spring ring 20 is, for example, formed of a metal alloy having good spring properties, i.e. which deforms elastically easily while being able to deform significantly without undergoing plastic deformation, especially Phynox® or amorphous metal alloys. Of course, spring ring 20 can also, in a variant, be made from a synthetic material.

According to a first example embodiment, the teeth of toothed ring 18 and lugs 40 of spring ring 20 have an asymmetrical shape in the plane defined by spring ring 20. The asymmetrical shape is, for example, a 'wolf tooth' shape, i.e. the teeth and the lugs are substantially right triangle-shaped. In the meshed position of a lug 40, the hypotenuse of the triangle formed by this lug 40 of the spring ring extends along the hypotenuse of the triangle formed by one of the teeth of toothed ring 18.

In this example embodiment, spring ring 20 can rotate with respect to toothed ring 18 in a single predefined direction: clockwise or anticlockwise depending on the shape chosen for the teeth and the lugs. This first example embodiment of the invention thus corresponds to a unidirectional rotating bezel 14.

According to a second example embodiment, the teeth of toothed ring 18 and lugs 40 of spring ring 20 have a symmetrical shape in the plane defined by spring ring 20. The symmetrical shape is, for example, an isosceles triangle or equilateral triangle.

In this example embodiment, spring ring 20 can rotate with respect to toothed ring 18 in one or other of the two directions: clockwise or anticlockwise. This second example embodiment of the invention thus corresponds to a two-directional rotating bezel 14.

Figure 2:
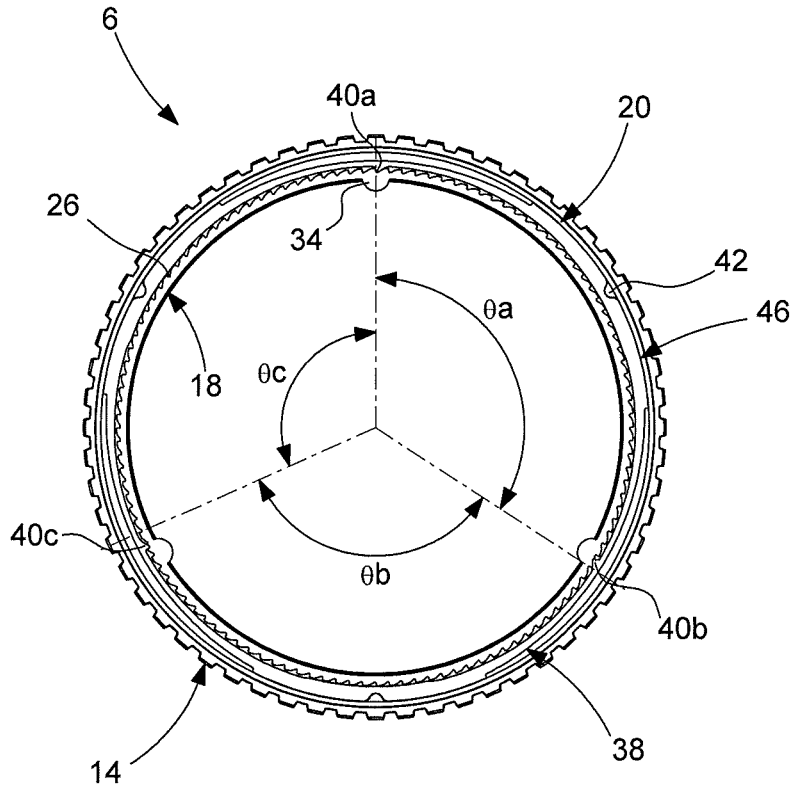
FIGS. 2 to 5 are top views of the annular rotating bezel system of FIG. 1, according to a first embodiment of the invention and in different positions of the bezel.
Figure 3:
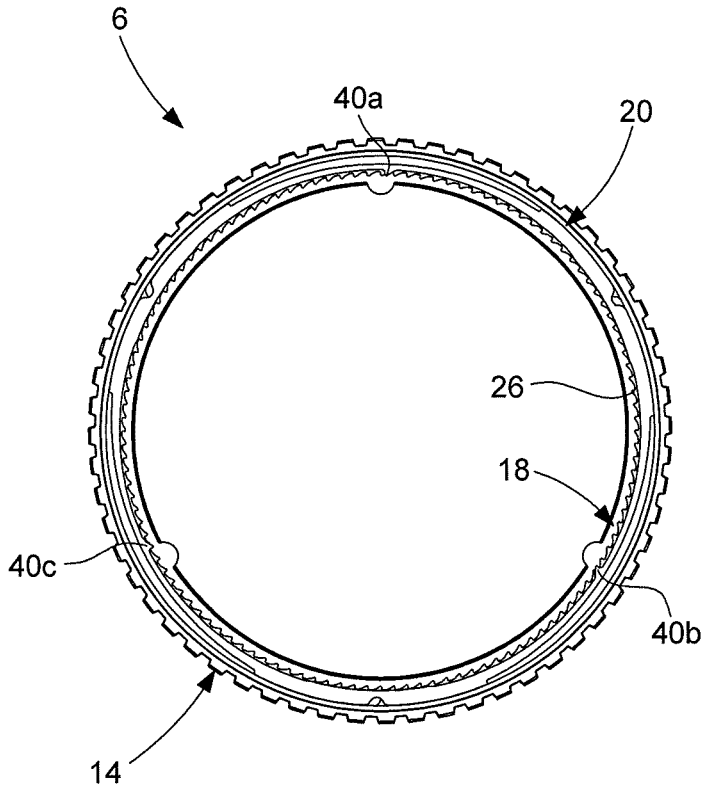
Figure 4:
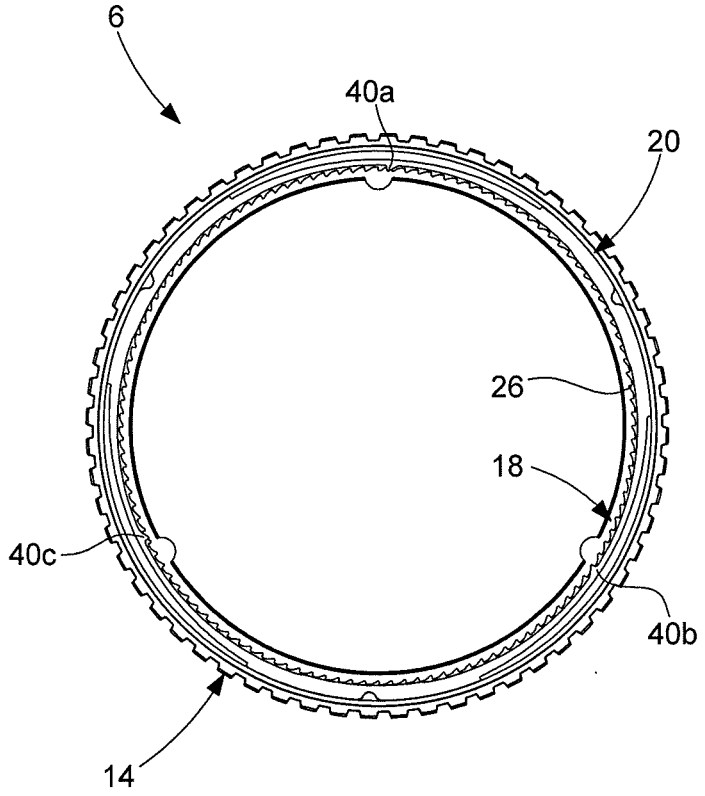
Figure 5:
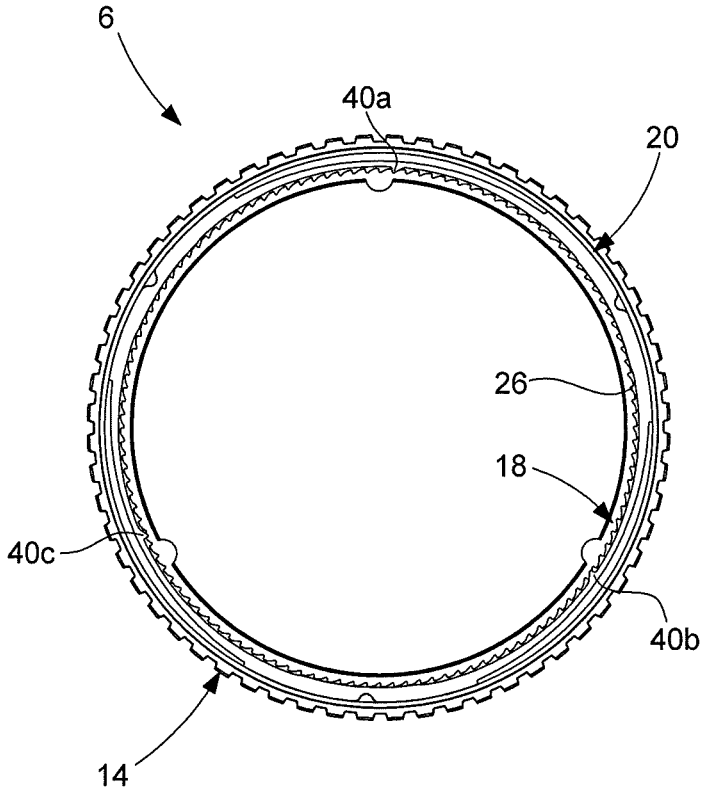

A first embodiment of the invention will now be described with reference to FIGS. 2 to 5. According to this first embodiment, the toothed ring has 120 teeth regularly distributed over its outer edge, and spring ring 20 has three lugs 40*a*, 40*b*, 40*c*. Since the total number of possible positions of bezel 14 is given by the result of multiplying the number of lugs 40*a*-40*c* on spring ring 20 by the number of teeth on toothed ring 18, the annular rotating bezel system 6 of this first embodiment has 360 possible stable positions. The spring ring includes a first lug 40*a*, a second lug 40*b* and a third lug 40*c*. As illustrated in FIG. 2, the first and second lugs 40*a*, 40*b* are offset from each other by an offset angle $\vartheta_a$, the second and third lugs 40*b*, 40*c* are offset from each other by an offset angle $\vartheta_b$, and the first and third lugs 40*a*, 40*c* are offset from each other by an offset angle $\vartheta_c$. The value of offset angle $\vartheta_a$ is 121 degrees, the value of offset angle $\vartheta_b$ is 121 degrees, and the value of offset angle $\vartheta_c$ is 118 degrees, Thus, the three lugs 40*a*-40*c* are distributed over an inner edge of spring ring 20 such that the angular spacing of lugs 40*a*-40*c* on spring ring 20 is offset by 1 degree with respect to a regular symmetrical distribution. Further, as indicated previously, each offset angle between two successive lugs 40*a*, 40*b*, 40*c* has a value different from an integer sub-multiple of 360 degrees.

FIG. 2 represents system 6 with bezel 14 in a '12 o'clock' position. In this position, only first lug 40*a* of toothed ring 20 is engaged with toothing 26. The second and third lugs 40*b*, 40*c* are in equilibrium on teeth of toothed ring 18. When the user takes hold of bezel 14 and rotates it 1 degree in the clockwise direction, system 6 adopts the configuration represented in FIG. 3. In this configuration, only third lug 40*c* of toothed ring 20 is engaged with toothing 26. The first and second lugs 40*a*, 40*b* are in equilibrium on teeth of toothed ring 18. When the user takes hold of bezel 14 and rotates it 1 degree in the clockwise direction, and thus 2 degrees with respect to the '12 o'clock' position, system 6 adopts the configuration represented in FIG. 4. In this configuration, only second lug 40*b* of toothed ring 20 is engaged with toothing 26. The first and third lugs 40*a*, 40*c* are in equilibrium on teeth of toothed ring 18. When the user takes hold of bezel 14 and rotates it 1 degree in the clockwise direction, and thus 3 degrees with respect to the '12 o'clock' position, system 6 adopts the configuration represented in FIG. 5. In this configuration, once again only first lug 40*a* of toothed ring 20 is engaged with toothing 26. The second and third lugs 40*b*, 40*c* are in equilibrium on teeth of toothed ring 18.

Figure 6:
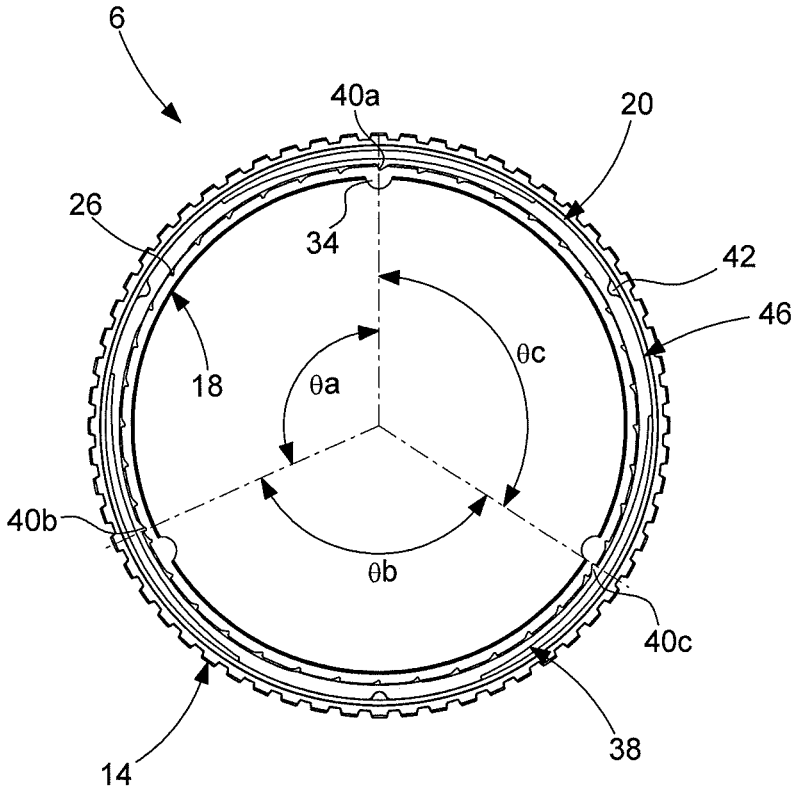
FIGS. 6 to 9 are top views of the annular rotating bezel system of FIG. 1, according to a second embodiment of the invention and in different positions of the bezel.
Figure 7:
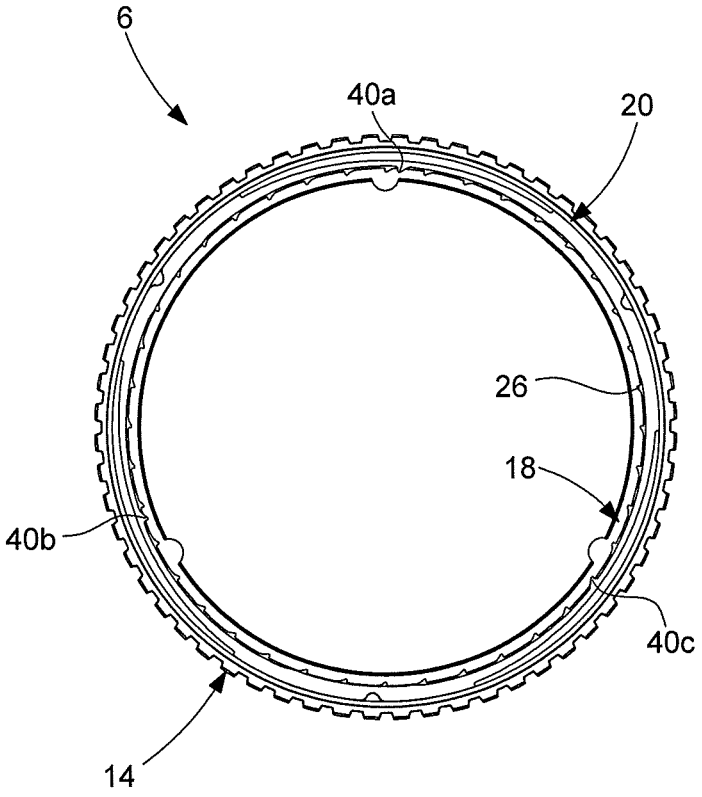
Figure 8:
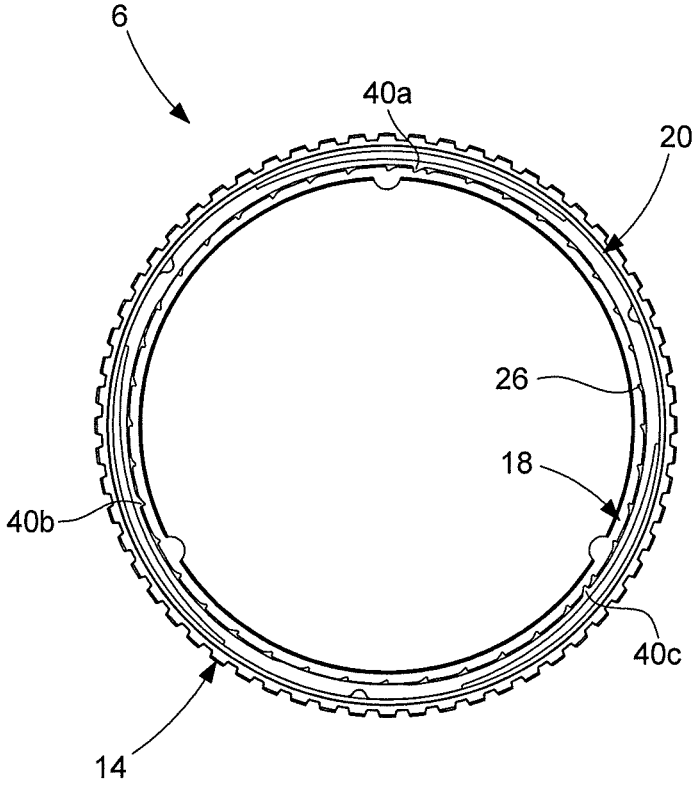
Figure 9:
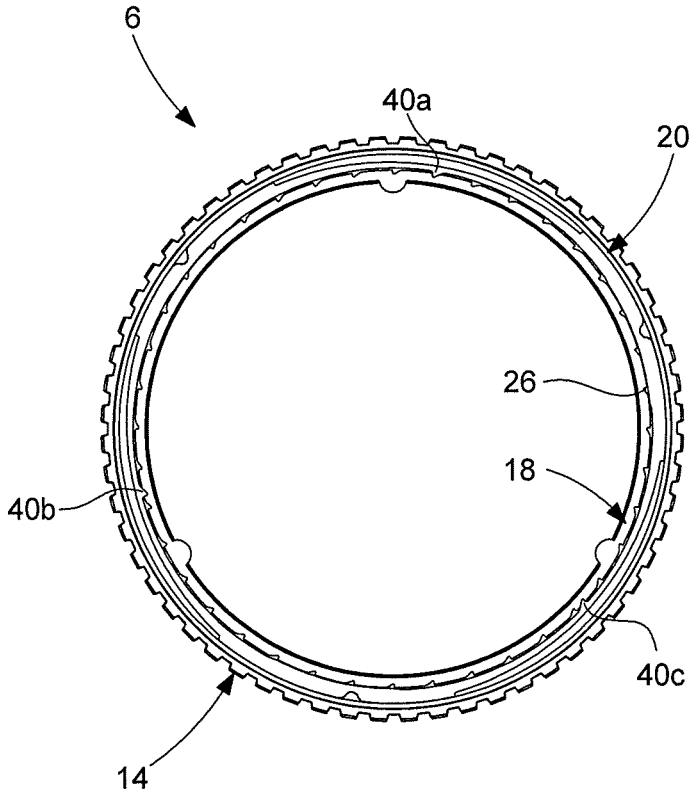

A second embodiment of the invention will now be described with reference to FIGS. 6 to 9. According to this second embodiment, the toothed ring has 40 teeth regularly distributed over its outer edge, and spring ring 20 has three lugs 40*a*, 40*b*, 40*c*. The annular rotating bezel system 6 according to this second embodiment thus has 120 possible stable positions. The spring ring includes a first lug 40*a*, a second lug 40*b* and a third lug 40*c*. As illustrated in FIG. 6, the first and second lugs 40*a*, 40*b* are offset from each other by an offset angle $\vartheta_a$, the second and third lugs 40*b*, 40*c* are offset from each other by an offset angle $\vartheta_b$, and the first and third lugs 40*a*, 40*c* are offset from each other by an offset angle $\vartheta_c$.

FIG. 6 represents system 6 with bezel 14 in a '12 o'clock' position. In this position, only first lug 40*a* of toothed ring 20 is engaged with toothing 26. The second and third lugs 40*b*, 40*c* are in equilibrium on teeth of toothed ring 18. When the user takes hold of bezel 14 and rotates it 3 degrees in the clockwise direction, system 6 adopts the configuration represented in FIG. 7. In this configuration, only third lug 40*c* of toothed ring 20 is engaged with toothing 26. The first and second lugs 40*a*, 40*b* are in equilibrium on teeth of toothed ring 18. When the user takes hold of bezel 14 and rotates it 3 degrees in the clockwise direction, and thus 6 degrees with respect to the '12 o'clock' position, system 6 adopts the configuration represented in FIG. 8. In this configuration, only second lug 40*b* of toothed ring 20 is engaged with toothing 26. The first and third lugs 40*a*, 40*c* are in equilibrium on teeth of toothed ring 18. When the user takes hold of bezel 14 and rotates it 3 degrees in the clockwise direction, and thus 9 degrees with respect to the '12 o'clock' position, system 6 adopts the configuration represented in FIG. 9. In this configuration, once again only first lug 40*a* of toothed ring 20 is engaged with toothing 26. The second and third lugs 40*b*, 40*c* are in equilibrium on teeth of toothed ring 18.

The preceding description of the annular rotating bezel system of the invention was made with reference to a toothed ring angularly joined to the case middle, and to a spring ring angularly joined to the rotating bezel. However, those skilled in the art will understand that the reverse configuration is possible without departing from the scope of the present invention, i.e. the toothed ring may be angularly joined to the rotating bezel, and the spring ring angularly joined to the case middle. Further, although the invention was described with reference to a spring ring provided with three lugs, the invention applies in the same manner to rotating bezel systems provided with spring rings having two lugs, or spring rings having four or more lugs.

The invention claimed is:

1. An annular rotating bezel system intended to be rotatably mounted on a middle part of a watch case inside which is housed a timepiece movement which extends in a plane, comprising a rotating bezel, a toothed ring having a toothing provided with a plurality of teeth regularly distributed over an edge of the toothed ring, and a spring ring which extends in a plane in which it is capable of deforming elastically along a radius, the spring ring cooperating elastically with the toothed ring, said toothed ring and said spring ring being held in an axial direction perpendicular to the plane of the movement in the bezel, either the toothed ring or the spring ring being arranged to be angularly joined to the rotating bezel, and the other being arranged to be angularly joined to the case middle, the spring ring including at least two lugs, each lug being configured to be elastically and radially engaged with the toothing of the toothed ring in at least one position of the bezel, wherein said at least two lugs are offset from each other by an offset angle, the or each offset angle between two successive lugs having a value different from an integer sub-multiple of 360 degrees, such that, in each position of the bezel, only one lug is elastically and radially engaged with the toothing of the toothed ring.

2. The annular rotating bezel system according to claim 1, wherein the system further includes an annular retaining ring, the toothed ring and the spring ring being held in the bezel by the annular retaining ring.

3. The annular rotating bezel system according to claim 1, wherein the spring ring includes three lugs.

4. The annular rotating bezel system according to claim 3, wherein the three lugs are distributed over an edge of the spring ring such that the angular spacing of the lugs on the spring ring is offset by 1 degree with respect to a regular symmetrical distribution.

5. The annular rotating bezel system according to claim 1, wherein said at least two lugs are configured such that, in each position of the bezel, when one of the lugs is elastically and radially engaged with the toothing of the toothed ring in said position of the bezel, the remaining lug or lugs are in equilibrium on teeth of the toothed ring.

6. The annular rotating bezel system according to claim 1, wherein the spring ring includes at least two thinned portions arranged to increase the flexibility of the spring ring in its plane, each lug extending from one of the thinned portions.

7. The annular rotating bezel system according to claim 6, wherein each thinned portion is radially thinned.

8. The annular rotating bezel system according to claim 6, wherein each lug is arranged in a median part of the corresponding thinned portion.

9. The annular rotating bezel system according to claim 1, wherein the rotating bezel includes at least one protrusion extending over an inner lateral surface of the bezel, and in that the spring ring has, on an outer edge, at least one hollow in which the protrusion of the bezel is engaged to allow a rotating connection between the spring ring and the rotating bezel.

10. The annular rotating bezel system according to claim 1, wherein the toothed ring has, on an inner edge, at least one protrusion intended to be received in a hollow provided in an external cylindrical surface of the case middle, to allow angular joining of the toothed ring to the case middle.

11. The annular rotating bezel system according to claim 1, wherein the spring ring is formed of a single piece of material consisting of a crystalline or amorphous metal alloy.

12. The annular rotating bezel system according to claim 1, wherein the toothed ring is formed of a single piece of material consisting of a metal alloy, especially phynox or steel.

13. The annular rotating bezel system according to claim 1, wherein the toothed ring is formed of a single piece of material consisting of a thermostable semi-crystalline thermoplastic material, especially thermostable polyetheretherketone particularly polyarylamide, or of a ceramic material particularly made from zirconia or alumina.

14. The annular rotating bezel system according to claim 1, wherein the teeth of the toothed ring and the lugs of the spring ring each have an asymmetrical shape in the plane defined by the spring ring.

15. The annular rotating bezel system according to claim 1, wherein the teeth of the toothed ring and the lugs of the spring ring have a symmetrical shape in the plane defined by the spring ring.

16. The annular rotating bezel system according to claim 1, wherein said system is formed of an independent module, said module being configured to be clipped onto the case middle.

17. A watch case comprising a case middle and a system (6) provided with an annular rotating bezel rotatably mounted on the case middle, wherein the annular rotating bezel system includes a rotating bezel, a toothed ring having a toothing provided with a plurality of teeth regularly distributed over an edge of the toothed ring, and a spring ring which extends in a plane in which it is capable of deforming elastically along a radius, the spring ring cooperating elastically with the toothed ring, said toothed ring and said spring ring being held in an axial direction perpendicular to the plane of the movement in the bezel (14), either the toothed ring or the spring ring being arranged to be angularly joined to the rotating bezel, and the other being arranged to be angularly joined to the case middle, the spring ring including at least two lugs (40; 40*a*-40*c*), each lug being configured to be elastically and radially engaged with the toothing of the toothed ring in at least one position of the bezel;

wherein said at least two lugs are offset from each other by an offset angle, the or each offset angle between two successive lugs having a value different from an integer sub-multiple of 360 degrees, such that, in each position of the bezel, only one lug is elastically and radially engaged with the toothing of the toothed ring.

18. The watch case according to claim 17, wherein the case middle includes an external cylindrical surface provided with a peripheral shoulder, the peripheral shoulder comprising, on a lateral face, an annular protrusion, and in that the rotating bezel is provided on an inner edge with an annular rim, said annular rim cooperating by clipping together with said annular protrusion and forming a free hooking system.

19. A watch comprising a watch case, wherein the watch case conforms to claim 17.

* * * * *